United States Patent [19]

Mortensen

[11] Patent Number: 5,048,593

[45] Date of Patent: Sep. 17, 1991

[54] APPARATUS FOR WEIGHTING AND LATERAL SUPPORT OF BOX-LESS SAND MOLD PARTS

[75] Inventor: Anders Mortensen, Bronshoj, Denmark

[73] Assignee: Dansk Industri Syndikat A/S, Herlev, Denmark

[21] Appl. No.: 475,973

[22] Filed: Feb. 6, 1990

[30] Foreign Application Priority Data

Feb. 28, 1989 [DK] Denmark ..... 0956/89

[51] Int. Cl.[5] ..... B22D 33/04; B22C 23/00

[52] U.S. Cl. ..... 164/341; 164/323; 164/394; 164/412

[58] Field of Search ..... 164/394, 395, 396, 341, 164/323, 384, 385, 386, 412

[56] References Cited

U.S. PATENT DOCUMENTS

| | | | |
|---|---|---|---|
| 671,057 | 4/1901 | Packer | 164/384 X |
| 1,002,522 | 9/1911 | Kimball | 164/396 |
| 1,204,528 | 11/1916 | Wood et al. | 164/394 |
| 1,676,200 | 7/1928 | Wood | 164/394 |
| 2,581,040 | 1/1952 | Mullenbach | 164/384 X |
| 3,556,196 | 1/1971 | Buhler . | |
| 4,438,801 | 3/1984 | Buhler . | |

FOREIGN PATENT DOCUMENTS

| | | | |
|---|---|---|---|
| 1965945 | 3/1971 | Fed. Rep. of Germany . | |
| 48-376 | 1/1973 | Japan | 164/412 |
| 58-100947 | 6/1983 | Japan | 164/341 |
| 1338963 | 9/1987 | U.S.S.R. | 164/394 |

*Primary Examiner*—J. Reed Batten, Jr.
*Attorney, Agent, or Firm*—Larson and Taylor

[57] ABSTRACT

The apparatus consists of a weight iron (1) with a plane bottom face designed to rest on the top side (3) of the upper mold of a two part sand mold set (2,6), and a clamping plate (4, 5) located at either side of the closed mold parts (2, 6). The bottom face (7) of the lower mold (6) rests on a transport device (8). The apparatus also includes L-shaped arms (9, 10), which pivot with respect to the weight iron (1) and the two side clamping plates (4, 5). The two L-shaped arms (9, 10) are placed opposite to each other in a vertical plane through the mold parts (2, 6). The arms (9, 10) are laterally off-set and pivot with the weight iron (1) at points (16, 17).

5 Claims, 5 Drawing Sheets

APPARATUS FOR WEIGHTING AND LATERAL SUPPORT OF BOX-LESS SAND MOLD PARTS

Figure 1:
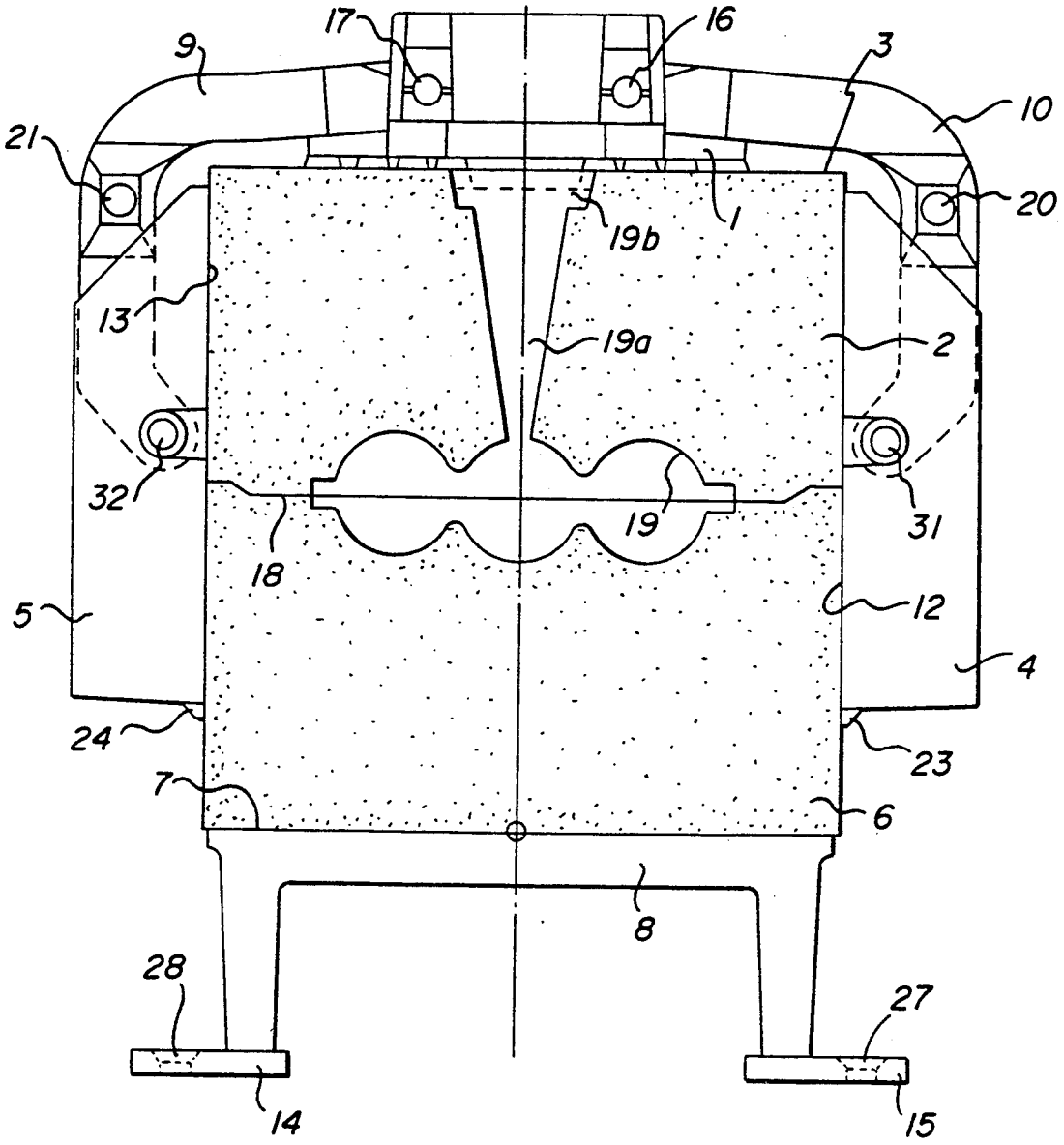

The invention concerns an apparatus for weighting and lateral support of box-less mold parts with a horizontal parting line, during the pouring, solidification and cooling, which apparatus comprises a weight iron with a plane bottom side, and designed to rest against the top side of the cope, and a clamping plate on either side of the closed mold parts, whereby the lower side of the drag rests on a transport device.

From German Auslegeschrift Nr. 30 11 265 a plant is known for the transportation of box-less sand molds. In that plant the molds are transported resting on top of each other with a horizontal mold parting line, and the molds are pressed against each other at their end faces, so that a long string of molds is produced. During the pouring the buoyancy and the hydrostatic pressure from the molten metal will try to press the mold parts apart at the parting line. The end faces are as mentioned kept in position in relation to each other by the mold parts pressed together, and the lower side of the drag rests on a transport device. The top side of the cope is loaded with a weight generating weight iron in the form of a heavy steel plate or similar, possibly supplemented with a heavy block or the like. The lateral support of the side faces of the mold is provided by side clamp plates, which by their own weight are pressed against the side faces of the mold by means of a link connection, and using the lever principle.

It has proved that the known weight iron and side clamp plates are relatively complicated devices, which are heavy and cumbersome to use in the foundry, and which protrude so much upwards from the top side of the cope that the use of automatic pouring apparatus is not possible.

From German Auslegeschrift Nr. 1.965.945 a device is known for the weighting and support of box-less sand molds. The clamp plates at the side faces of the mold parts are, however, not moved by means of a complicated rod mechanism, see in particular FIG. 3 of the specification, which protrudes a considerable distance up above the top side of the cope, whereby the access to the pouring gates on the top side of the mold parts is impeded, and in practice it will not be possible to use automatic pouring, because this will involve a complicated pattern of movements in and out between the successive mold parts. Alternatively it will involve an unacceptably large height difference between ladle and gate. In addition, the multi-link rod mechanism is vulnerable because it is easily damaged in a foundry by spilt iron.

From German Auslegeschrift Nr. 2.654.442 one more apparatus is known for weighting and support of box-less sand molds. That construction, however, uses four separate clamping plates, which are design for a frictional engagement with oblique wedge surfaces of downward protruding side branches belonging to a weight-generating yoke, which is placed above the mold parts, resting on the top side of the cope. The clamping plates are designed to abut on the end faces of the mold parts, and therefore the scope of invention is different from the one mentioned in the introduction, where the end faces of the mold parts are pressed positively against each other without any kind of intermediary. It has also proved that positioning the clamping plates and the subsequent liberation of same from the frictional engagement with the oblique wedge faces are difficult operations, and that there is no complete certainty that the clamping plates are automatically positioned correctly, whereby the yoke may rest suspended above the top side of the mold parts, with the consequent risk of the molds opening in relation to each other during the pouring.

The purpose of the invention is to provide an apparatus which is simple, sturdy and reliable and can be used with automatic pouring equipment.

This purpose is achieved with an apparatus of the kind mentioned in the introduction, which is characterised by a mainly L-shaped arm being pivotally connected to respectively the weight iron and to each side clamping plate, and by the two L-shaped arms being positioned opposite to each other in the same vertical plane through the mold parts, the arms being taken past each other laterally transposed in a horizontal plane, and pivotally connected to the weight iron in a point situated between the longitudinal symmetry plane of the mold parts in the direction of transportation, and the side face situated opposite to the clamping plate of the arms.

By designing the arms in such a way that they can be passed laterally past each other in a horizontal plane above the top side of the mold parts, a weight arm which is long in relation to the width of the mold parts is obtained, whereby the torque created by the weight of the clamping plates and thereby the contact pressure against the side faces of the mold parts will be correspondingly high, so that it is possible to use clamping plates of relatively small weight. The design and hingeing of the arms at a relatively short distance above the top side of the mold parts also makes it possible to place gates over the entire part of the sand surface not covered by the weight iron and the arms, of which one pair is preferably placed at each end of the mold parts.

In the case of a preferred design, the transport device has protruding parts designed to form a supporting surface for the side clamping plates when no mold parts are present on the transport device.

In this way a practical solution is achieved for removal of the relatively heavy apparatus when the plant is not in operation. In known plant, where the mold parts must remain on the transport devices in order to carry the weight iron, there is a risk that moisture seeping out from mold parts will cause weight irons and clamping plates to rust during prolonged periods of stand-still.

According to the invention, the protruding parts may have recesses designed to receive corresponding projections on the bottom faces of the clamping plates. By this measure a well-defined positioning of the whole arrangement is ensured during such periods of stand-still.

In the case of yet another design version of the apparatus according to the invention, the protruding parts can move freely between a rest position, where they are concealed in the transport device, and an active position, where they protrude from the transport device. During normal operation, where there is no need for supporting the apparatus, the protruding parts may be pushed into their rest position, so that they are not an obstruction for the personnel working at the string of box-less mold parts.

According to the invention, the weight of the clamping plates can be adjusted infinitely by placing weight units in a detachable way on a base plate.

In this way it becomes possible to optimize the load of the mold parts, because different weighting and different support to suit the degree of utilisation of the mold volume and its distribution in relation to the surfaces of the mold parts. If the actual loading is too low, the mold parts will open in relation to each other during the pouring, whereby the cast is ruined, of course. If, on the other hand, the load is too great, the mold impressions will in the best case be deformed, ca sing the cast to be inaccurate, and in the worst case the sand molds will be crushed.

In the following the invention will be explained with reference to the drawing, in which FIG. 1 shows an apparatus according to the invention, seen from the end and placed above two sand mold parts shown in section with a horizontal parting line, FIG. 2 the same, but without mold parts, FIG. 3 the apparatus seen from above, partly in section, FIG. 4 the apparatus seen from one side placed on top of the mold parts with horizontal parting face, and FIG. 5 three adjacent pairs of mold parts placed each on its own transport device and each with its own apparatus according to the invention.

The apparatus shown in FIG. 1 consists of a weight iron 1 in the shape of a heavy plate designed to rest on the top side 3 of a upper mold part 2. The upper mold part 2 is placed on top of a lower mold part 6 forming a horizontal mold parting line 18 such that pattern face 19 produces a mold cavity with gate **19*a* and a pouring cup 19*b***.

The lower mold part 6 has a bottom face 7, resting on a transport device, which in the case of the construction shown in the drawing is designed as a pallet 8, which is arranged to support the mold parts and to glide or roll on a conveyor.

The mold parts are supported on their side faces by clamping plates 4, 5, which are pivot connected with the weight iron 1 via mainly L-shaped arms 9, 10, which are hinged at respectively 16 and 17 to a bracket in fixed connection with the weight iron 1. The clamping plates 4 and 5 are pivotally connected at the ends 31 and 32 of L-shaped arms 9, 10 (see also FIG. 3). The clamping plates are placed above the mold parts by lowering them suspended by the studs 21 and 20, which protrude at right angles from the L-shaped arms 9 and 10 (see also FIG. 3). The torque provided by the weight of the clamping plates 4 and 5 ensures a positive clamping force against the side faces 12 and 13 of the mold parts.

Figure 2:
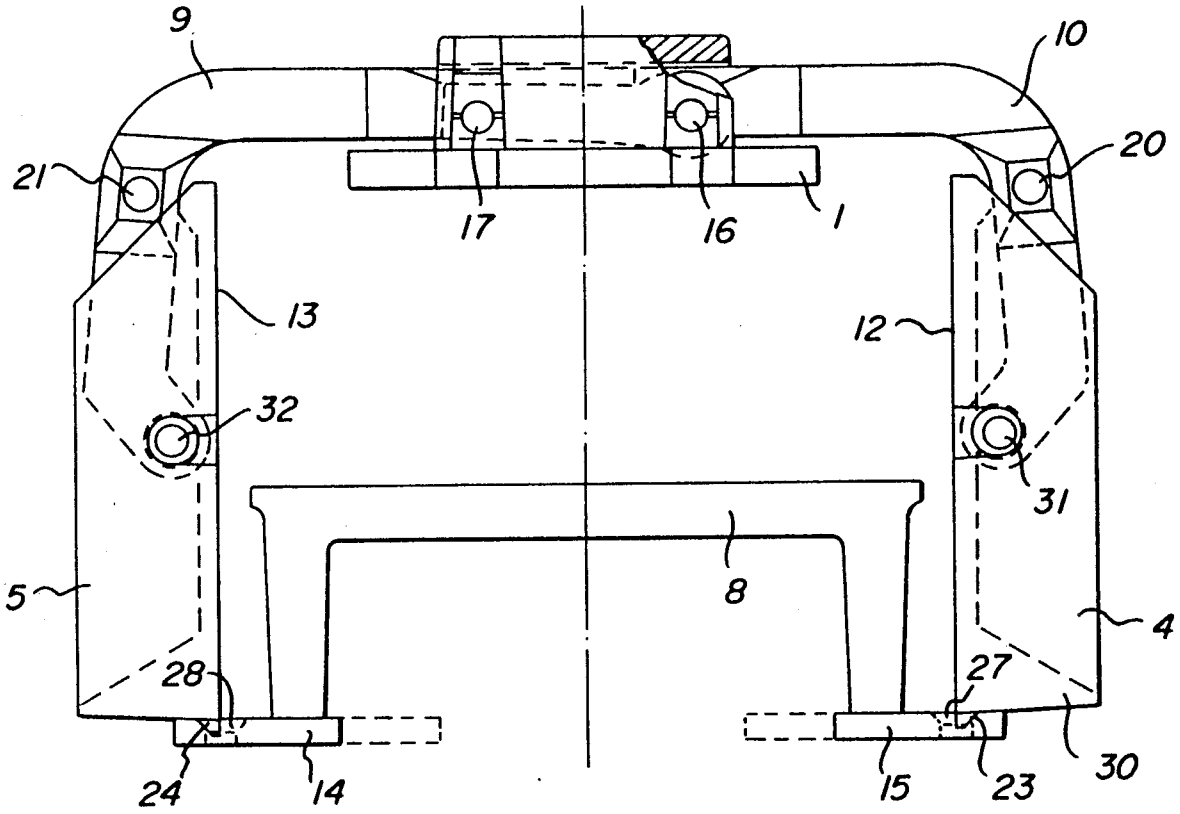

In FIG. 2 the apparatus is shown in a position where there are no mold parts placed on the transport device 8. In this rest position the projections 23, 24 on the bottom faces of the clamping plates are placed in corresponding recesses 27 and 28 in the projecting parts 15 and 14 at the base of the pallet. In the case of a preferred design, the projecting parts 14 and 15 can be turned around to a rest position (suggested by the dashed lines in FIG. 2), where they are hidden in the transport device 8, so that they do not project, forming an obstruction to the persons working along the string of molds. With devices placed as shown in FIG. 2, they can by means of the pallets 8 be conveyed along through the plant. The clamping plates 4 and 5 are placed above and removed from the protruding parts 14 and 15 of the pallets by means of lifting tackle lifting by the studs 20 and 21 in a known way.

Figure 3:
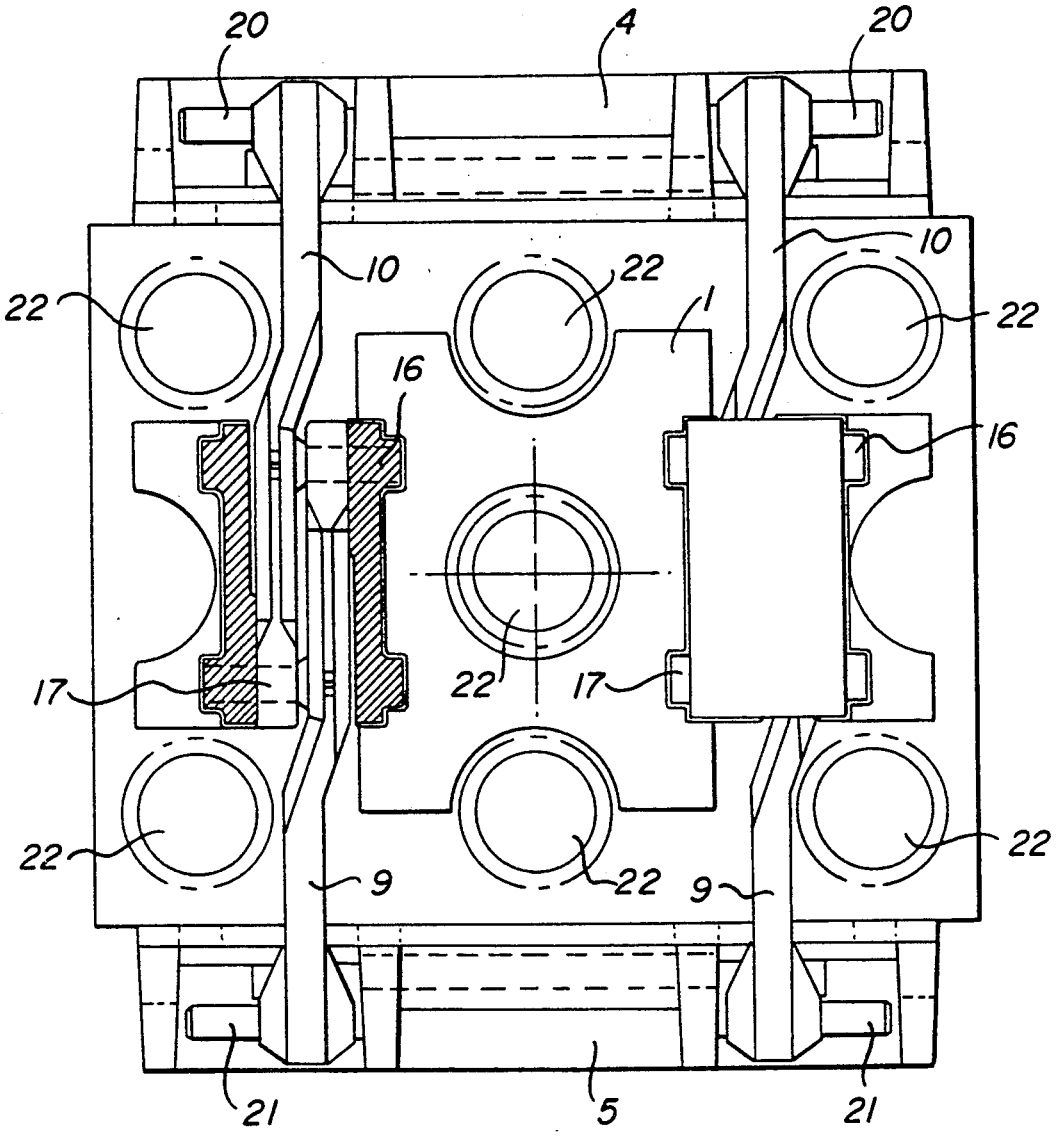

In FIG. 3 the apparatus is shown from above, and it is indicated how the L-shaped arms 9 and 10 are taken past each other laterally off-set (see the section through a plane of the arms to the left) and suspended in an area between the longitudinal centre line (CL) and the opposite side face. The points of suspension are indicated by the references 16 and 17 respectively, and in the design shown they have the form of frame connected studs carried in bearings at the free ends of the L-shaped arms. In FIG. 3 the studs 20 and 21 for the lifting tackle are also clearly shown. Finally there are indications of possible positions of gates in the areas 22. It appears that it is possible to place a total of seven relatively large gates evenly spread across the face of the upper mold part.

Figure 4:
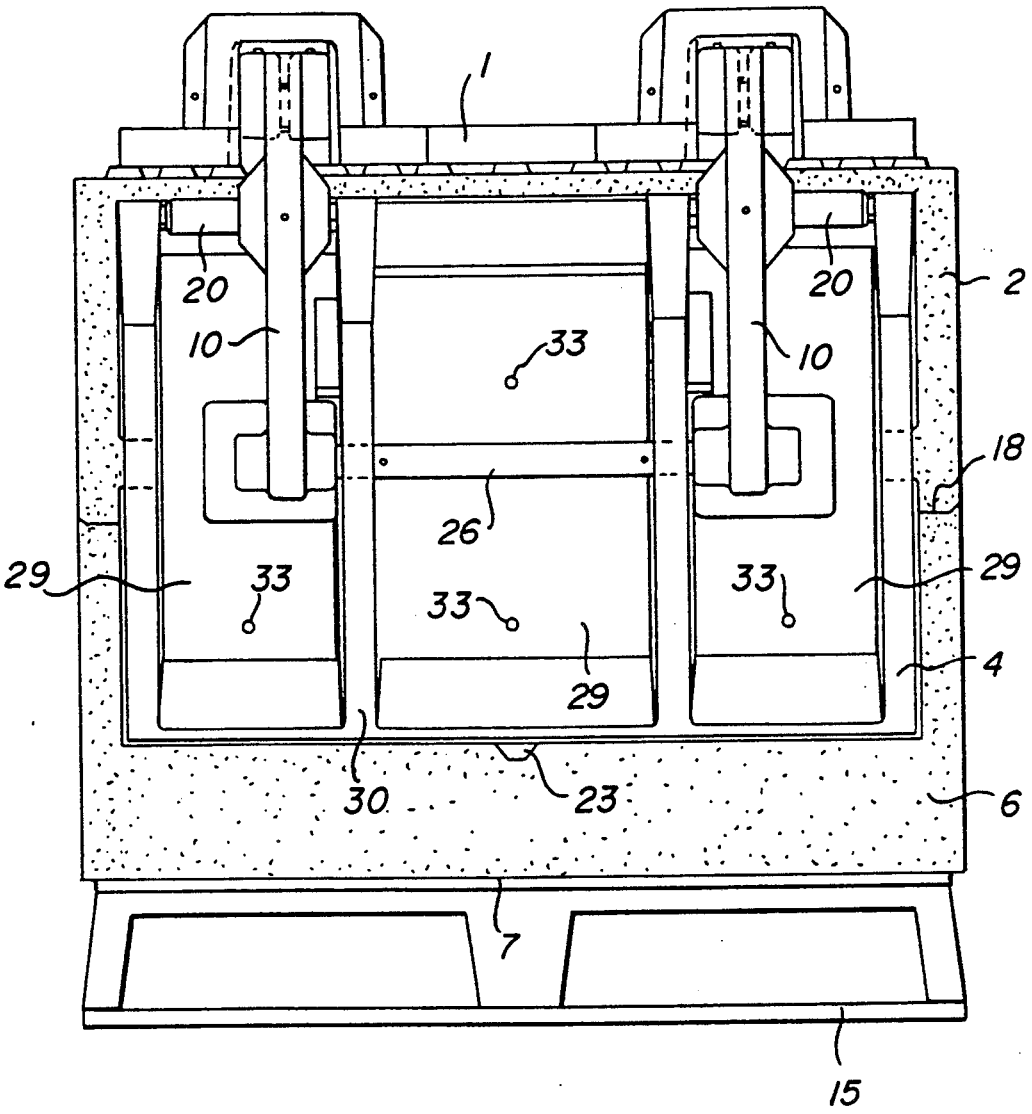

In FIG. 4 the apparatus is shown from the side. The mold parting line is indicated by reference 18. On a base plate 30 exchangeable weights 29 have been mounted, screwed on to the base plate 30 by means of screws 33.

Figure 5:
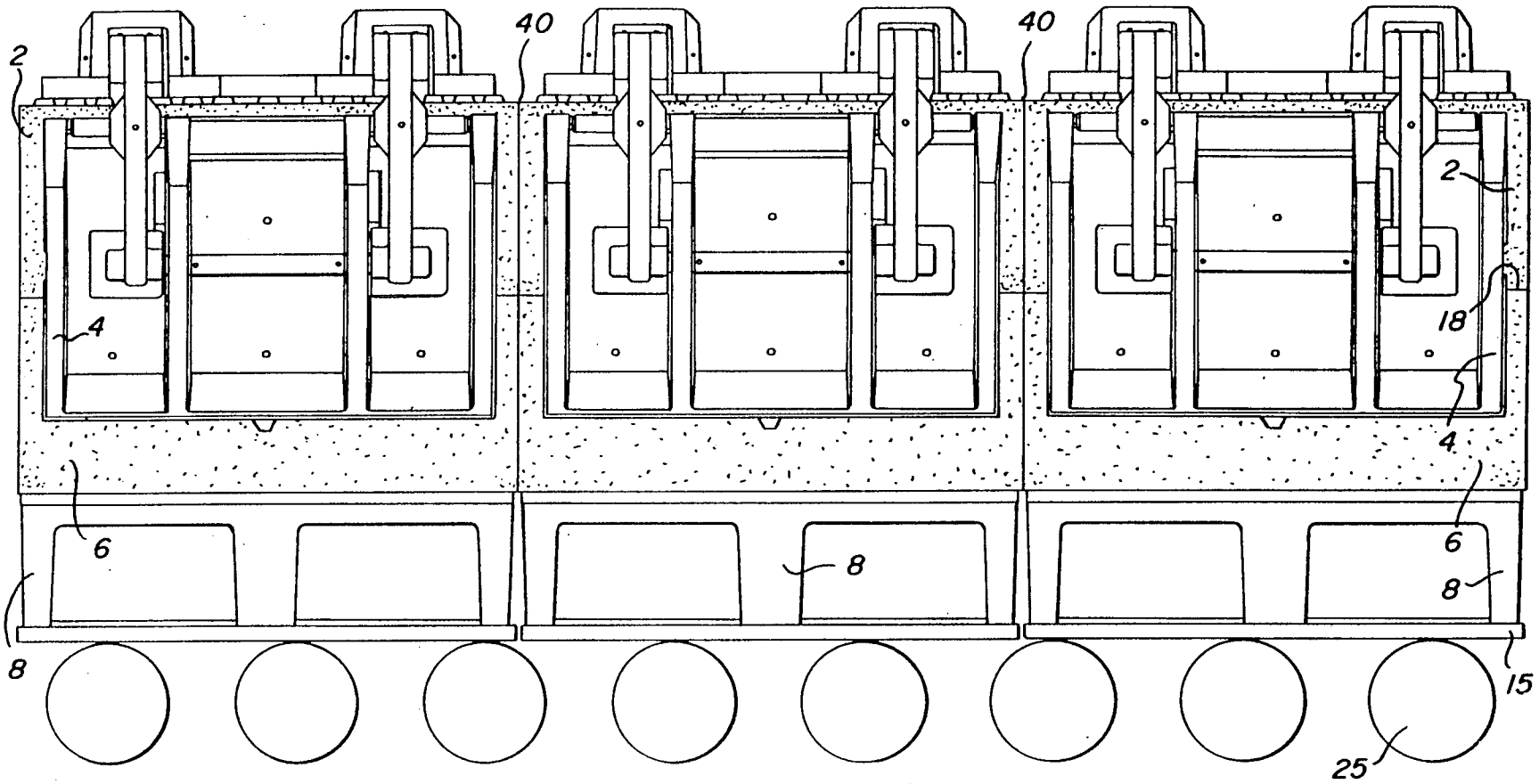

FIG. 5 is a side view of three pairs of mold parts 2 and 6 placed on top of each other with a horizontal parting line 18. It is important to note that the end faces 40 of the mold parts abut each other directly, the pallets 8 being shorter than the mold parts 6 and 2. The pallets 8 are supported by a conveyor, which in the form shown in FIG. 5 is a roller conveyor, of which only the rollers 25 are shown.

I claim:

1. Apparatus for weighting and laterally supporting box-less sand mold parts during pouring, solidification and cooling, said mold parts comprising an upper mold part and a lower mold part and having opposing side faces, said apparatus comprising; a weight iron having a plane bottom face abutting a top side of said upper mold part, and two clamping plates for positioning one at each side of said mold parts, whereby the bottom side of said lower mold part rests on a transport device movable in a direction of transportation, wherein said apparatus is further characterised by two substantially L-shaped arms each pivotally connected at one end to said weight iron and at another end to one of said side clamping plates, said two L-shaped arms being mounted opposite to each other in a vertical plane through said mold parts, said arms being laterally off-set in a horizontal plane and pivotally connected to said weight iron at a point situated between the longitudinal symmetry line of the mold parts in said direction of transportation and the side face opposite to said clamping plate of said arms.

2. Apparatus according to claim 1, characterised by said transport device having protruding parts forming a supporting face for said side clamping plates, when no mold parts are present on said transport device.

3. Apparatus according to claim 2, characterised by the protruding parts having recesses for receiving corresponding projections on the bottom side of said clamping plates.

4. Apparatus according to claim 2, characterised by said protruding parts being movable between a resting position, in which said protruding parts are received in said transport device, and an active position, in which said protruding parts project from said transport device.

5. Apparatus according to claim 1, characterised by the weight of said clamping plates being infinitely adjustable by detachable mounting weight units provided on a base plate.

* * * * *